US009313866B2

(12) United States Patent
Han

(10) Patent No.: US 9,313,866 B2
(45) Date of Patent: Apr. 12, 2016

(54) LIGHT STRING

(71) Applicant: Houhua Han, Suizhou (CN)

(72) Inventor: Houhua Han, Suizhou (CN)

( * ) Notice: Subject to any disclaimer, the term of this patent is extended or adjusted under 35 U.S.C. 154(b) by 0 days.

(21) Appl. No.: 13/915,668

(22) Filed: Jun. 12, 2013

(65) Prior Publication Data

US 2014/0300286 A1 Oct. 9, 2014

(30) Foreign Application Priority Data

Apr. 8, 2013 (CN) ..... 2013 2 0169368 U
Apr. 18, 2013 (CN) ..... 2013 2 0197290 U

(51) Int. Cl.
*F21S 4/00* (2006.01)
*H05B 39/00* (2006.01)
*H05B 37/00* (2006.01)

(52) U.S. Cl.
CPC ..... *H05B 39/00* (2013.01); *H05B 37/00* (2013.01)

(58) Field of Classification Search
CPC ..... F21S 4/00; F21S 4/003; H05B 39/045; H05B 39/00; H05B 33/0803; H05B 33/0815; H05B 41/232; Y02B 20/142; F21Y 2101/02
USPC ..... 315/187, 185 S, 185 R, 192, 312, 188, 315/291; 362/249.01, 234, 227, 253, 362/249.14, 249.19
See application file for complete search history.

(56) References Cited

U.S. PATENT DOCUMENTS 5,880,581 A * 3/1999 Yang ..... 323/288
7,029,145 B2 * 4/2006 Frederick ..... 362/234
7,679,292 B2 * 3/2010 Allen ..... H05B 33/0803 315/185 S
7,986,101 B2 * 7/2011 Neuman ..... H05B 37/0281 315/200 R
8,093,819 B2 1/2012 Tsai
8,324,820 B2 * 12/2012 Janning ..... 315/185 R
8,836,224 B2 * 9/2014 Chen et al. ..... 315/185 R
8,917,027 B2 * 12/2014 Radermacher et al. ... 315/200 R
2008/0013324 A1 * 1/2008 Yu ..... 362/311
2009/0128042 A1 * 5/2009 Janning ..... 315/122
2010/0148694 A1 6/2010 Chang et al.
2013/0214247 A1 * 8/2013 Hu ..... 257/13
2013/0308301 A1 * 11/2013 Chen ..... 362/123

FOREIGN PATENT DOCUMENTS

CN 2921561 Y 7/2007
CN 101504117 A 8/2009
CN 201475770 U 5/2010

OTHER PUBLICATIONS

SIPO, PCT International Search Report and Opinion, Intl. App. No. PCT/CN2014/074807.

* cited by examiner

*Primary Examiner* — Haissa Philogene

(57) ABSTRACT

A light string includes a number of lights. The lights are electrically connected in series and powered by an AC power supply. At least one capacitor is connected in parallel to one of the lights. Each light or a part of lights of the light string of the present invention is electrically connected in parallel to a capacitor. When the light string is powered on, the capacitor is charged and absorbs a surge current which may occur. Thus, the voltage dropped on each light rises slowly and the lights are safe. The capacitor also performs power compensation and electrical connection. When the filament of the light bulb fails and the bulb remains in the light string, or when the bulb is removed from its socket for replacement, the closed path for flow of electrical current is still closed.

7 Claims, 8 Drawing Sheets

LIGHT STRING

CROSS-REFERENCE TO RELATED APPLICATIONS

None.

BACKGROUND OF THE INVENTION

1. Field of the Invention

The invention relates to electric light strings.

2. Description of Related Art

Light strings are widely used for decorative purposes, especially for holiday lighting. Light strings refer to lights connected electrically in a series. Generally, a light string includes more than 10 lights, and is powered by mains electricity, such as 110V AC mains electricity. Thus, a voltage supplied on each light is 1.5V to 12V. When the light string is powered on, a surge current may be generated and may burn out the light bulb mounted in a lamp base. In the conventional light strings, when the filament of the light bulb fails and the bulb remains in the string, or when the bulb is removed from its socket for replacement, the closed path for the flow of electrical current is interrupted and the remainder of the lamps in the string will no longer be illuminated.

BRIEF SUMMARY OF THE INVENTION

An object of the present invention is to provide an improved light string, when the filament of the light bulb fails and the bulb remains in the light string, or when the bulb is removed from its socket for replacement, the closed path for flow of electrical current is still closed, and the surge current can be absorbed.

A light string includes a plurality of lights and at least one capacitor. The lights being electrically connected in series and powered by an AC power supply. Each of the at least one capacitor is connected in parallel to a corresponding one of the lights.

In one embodiment, the light string further includes at least one zener diode each connected in series with one of the at least one capacitor, a series branch of each zener diode and the corresponding capacitor is connected in parallel to the corresponding light.

In another embodiment, each series branch of each zener diode and the corresponding capacitor is further connected in parallel to a diode.

In another embodiment, light string further includes at least one zener diode each connected in parallel to one of the at least one capacitor.

In further another embodiment, the light string further includes at least one resistor each connected in series with one of the at least one capacitor, a series branch of each resistor and the corresponding capacitor is connected in parallel to the corresponding light.

In another embodiment, the capacitor includes two pins for electrically connection, one of the pins is resistance wire and performs as the resistor which connected in series with the capacitor.

In another embodiment, the light string further includes at least one resistor each connected in parallel to one of the at least one capacitor.

In another embodiment, light string further includes at least one zener diode series branch each connected in parallel to one of the at least one capacitor, each zener diode series branch comprises two inverse connected zener diodes.

Preferably, each light is connected in parallel to a capacitor.

Furthermore, the lamp of the light can be chosen from tungsten filament lamps and LED lamps.

Preferably, the light string further includes a capacitor series branch connected between the AC power supply and the plurality of lights, the capacitor series branch comprises a plurality of capacitors, two ends of the capacitor series branch are respectively used for connecting to the two outputs of the AC power supply; the light series branch composed of the plurality of lights is connected in parallel to at least one of the capacitor of the capacitor series branch.

Preferably, the light string further includes a power plug, a corresponding end socket, and at least two electric wires electrically connecting the power plug and the end socket; a plurality of capacitor series branches are electrically connected in parallel to the electric wires, the capacitors of the plurality of capacitor series branch are configured on at least one circuit board.

Preferably, the light series branch is detachably connected to the circuit board to electrically connect to one of the capacitor series branch.

Preferably, the light string further includes at least one connecting base each for receiving one of the at least one circuit board, each connecting base comprises a plurality of connecting sockets, each connecting socket is configured on the side wall of the connecting base and is electrically connected to one of the capacitor series branches.

Preferably, each connecting base defines two wire holes on the upper and lower surfaces respectively, the power plug and the end socket is configured on the two sides of the connecting base respectively.

Preferably, the connecting base is substantially annular and defines a gap therein to allow a post inserting a hole defined in the connecting base.

Preferably, the wires used in the light series branches are larger than 22 AWG, the electric wires electrically connecting the power plug and the end socket and the wires used in the capacitor series branches are smaller than 22 AWG.

Each light or a part of lights of the light string of the present invention is electrically connected in parallel to a capacitor. When the light string is powered on, the capacitor is charged and absorbs the surge current which may occur. Thus, the voltage dropped on each light rises slowly and the lights are safe. The capacitor also performs power compensation and electrical connection. When the filament of the light bulb fails and the bulb remains in the light string, or when the bulb is removed from its socket for replacement, the closed path for flow of electrical current is still closed.

BRIEF DESCRIPTION OF THE SEVERAL VIEWS OF THE DRAWING(S)

The foregoing and other exemplary purposes, aspects and advantages of the present invention will be better understood in principle form the following detailed description of one or more exemplary embodiments of the invention with reference to the drawings, in which.

DETAILED DESCRIPTION OF THE INVENTION

The invention will now be described in detail through several embodiments with reference to the accompanying drawings.

Figure 1:
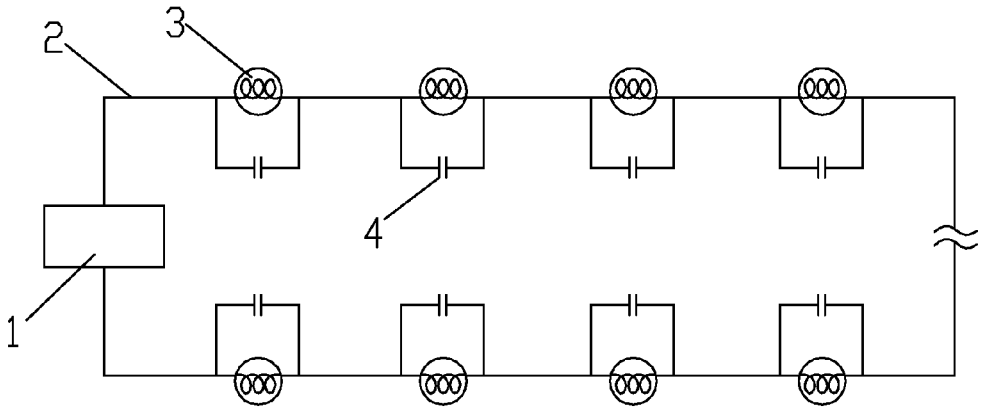
FIG. 1 is a part of the circuit diagram of a light string in accordance with a first embodiment of the invention.

Referring to FIG. 1, a light string according to a first embodiment of the present invention mainly includes a plurality of lights 3 which are electrically connected in series by wires 2. The plurality of lights 3 may be electrically connected to an AC power supply via a power module 1. The AC power supply is preferably an AC mains electricity. The lights 3 may use tungsten filament lamps or light emitting diode (LED) lamps. As a rated voltage of the lights 3 is low, generally 1.5 volts to 12 volts, the light string usually includes more than 10 lights when connecting to 110V mains electricity.

In the embodiment, each light 3 is electrically connected in parallel to a capacitor 4. Preferably, the capacitance of the capacitor 3 is larger than 3 μF (microfarad). In this way, when the light string is powered on, the capacitor 4 is charged and absorbs the surge current in the wires 2. Thus, the voltage dropped on each light 3 rises slowly and the lights 3 are safe. The capacitor 4 also performs power compensation and electrical connection. When the filament of the light bulb fails and the bulb remains in the light string, or when the bulb is removed from its socket for replacement, the closed path for flow of electrical current is still closed and allows the remaining lights to continue to operate. It is understandably, in other embodiments, only a part of the lights 3 in the light string is connected in parallel to a capacitor 4. It is noted that the type of the capacitor 4 is not limited, any capacitor which can achieve the above described functions can be used in the circuit.

Generally, each light 2 includes a bulb and a socket for holding the bulb. The socket is configured electrical connectors (generally two sheets) for electrically connecting the pins of the bulb. The capacitor 4 may electrically connect to the electrical connectors to realize the parallel connection to the bulb.

Figure 2:
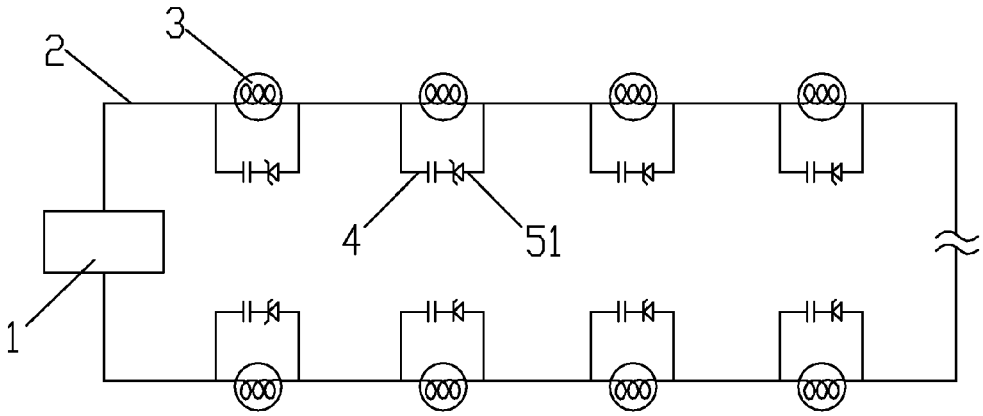
FIG. 2 is a part of the circuit diagram of a light string in accordance with a second embodiment of the invention.

Referring to FIG. 2, a light string according to a second embodiment of the present invention further includes a zener diode 51 connected in series with the capacitor 4 when comparing with the first embodiment. The series branch of the capacitor 4 and the zener diode 51 is connected in parallel to the corresponding light 3. The operating principle of the circuit is the same as that of the circuit of the first embodiment. The zenner diode 51 is desired to perform voltage limiting and current limiting.

Figure 3:
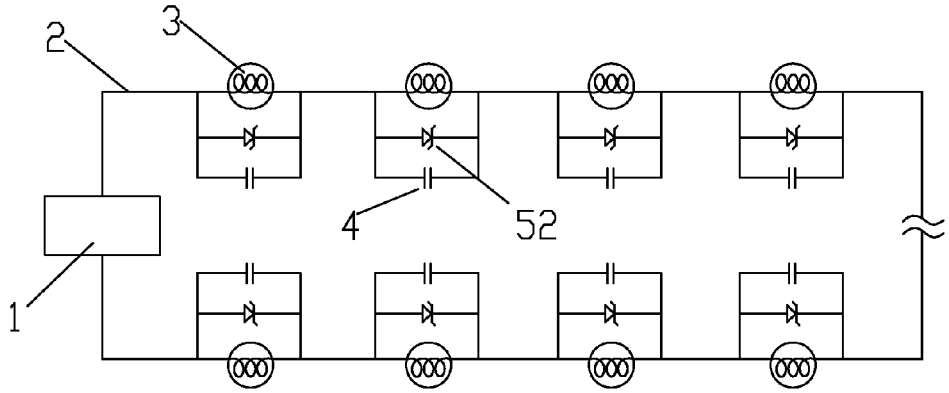
FIG. 3 is a part of the circuit diagram of a light string in accordance with a third embodiment of the invention.

Referring to FIG. 3, a light string according to a third embodiment of the present invention further includes a zener diode 52 connected in parallel to the capacitor 4 when comparing with the first embodiment. The operating principle of the circuit is the same as that of the circuit of the first embodiment.

Figure 4:
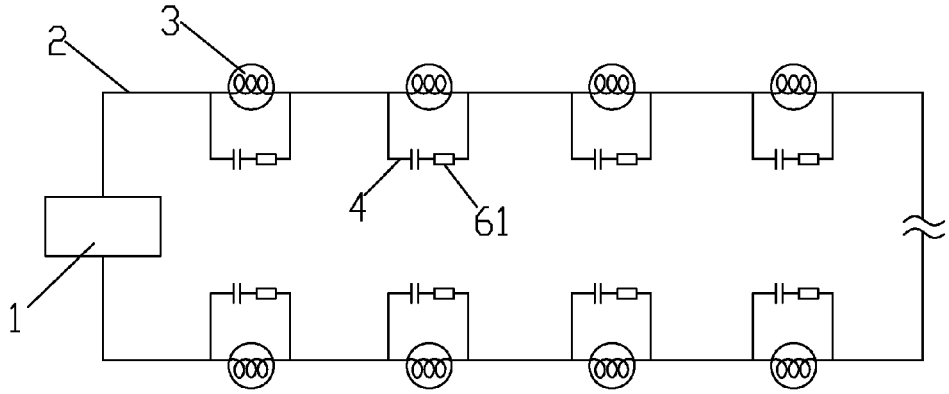
FIG. 4 is a part of the circuit diagram of a light string in accordance with a forth embodiment of the invention.

Referring to FIG. 4, a light string according to a fourth embodiment of the present invention further includes a resistor 61 connected in series with the capacitor 4 when comparing with the first embodiment. The series branch of the capacitor 4 and the resistor 61 is connected in parallel to the corresponding light 3. The operating principle of the circuit is the same as that of the circuit of the first embodiment. The resistor 61 is desired to perform voltage limiting and current limiting.

Figure 5:
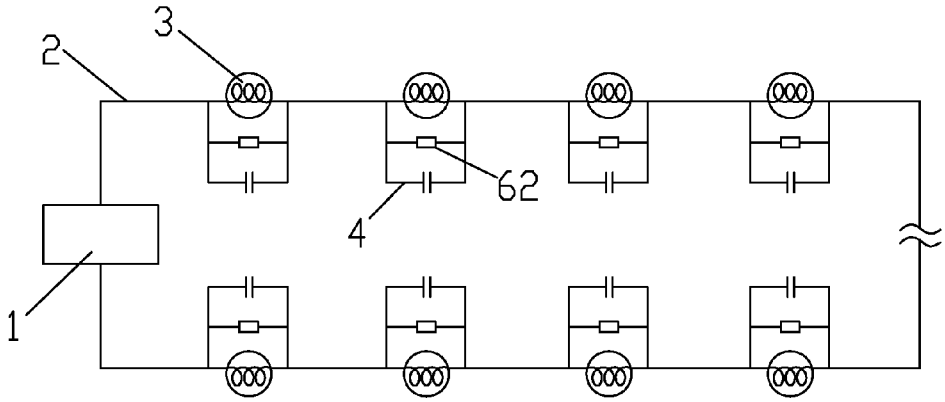
FIG. 5 is a part of the circuit diagram of a light string in accordance with a fifth embodiment of the invention.

Referring to FIG. 5, a light string according to a fifth embodiment of the present invention further includes a resistor 62 connected in parallel to the capacitor 4 when comparing with the first embodiment. The operating principle of the circuit is the same as that of the circuit of the first embodiment.

Figure 6:
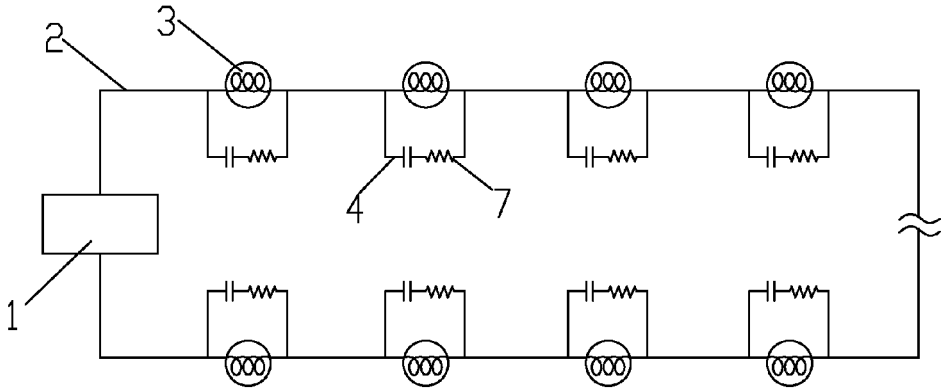
FIG. 6 is a part of the circuit diagram of a light string in accordance with a sixth embodiment of the invention.

Referring to FIG. 6, a light string according to a sixth embodiment of the present invention is similar to the light string in the fourth embodiment, the resistor 61 is replaced by a resistance wire 7. The series branch of the capacitor 4 and the resistance wire 7 is connected in parallel to the corresponding light 3. In detail, the capacitor 4 includes two pins for electrically connection, and one of the pins use a resistance wire to performs as the resistor 61 in the fourth embodiment. In this way, the capacitor 7 and the resistance wire 7 are integrated together, thus facilitate the production and manufacture of the light string.

Figure 7:
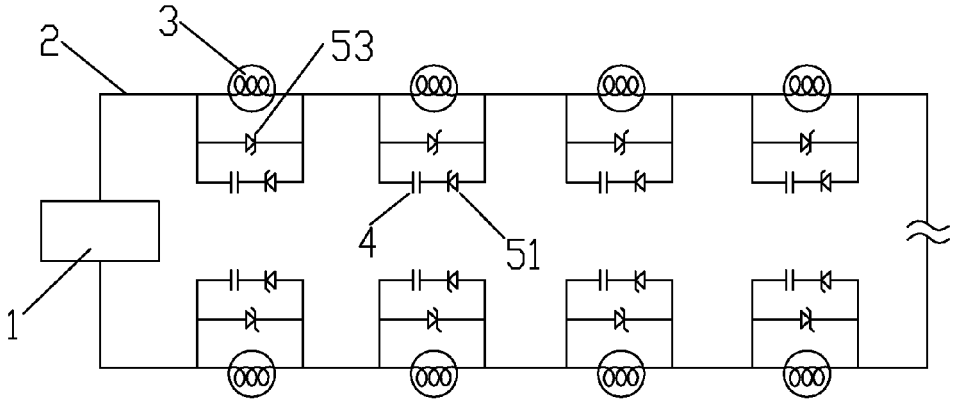
FIG. 7 is a part of the circuit diagram of a light string in accordance with a seventh embodiment of the invention.

Referring to FIG. 7, a light string according to a seventh embodiment of the present invention further includes a diode 53 connected in parallel to each light 3 when comparing with the second embodiment. The operating principle of the circuit is the same as that of the circuit of the second embodiment.

Figure 8:
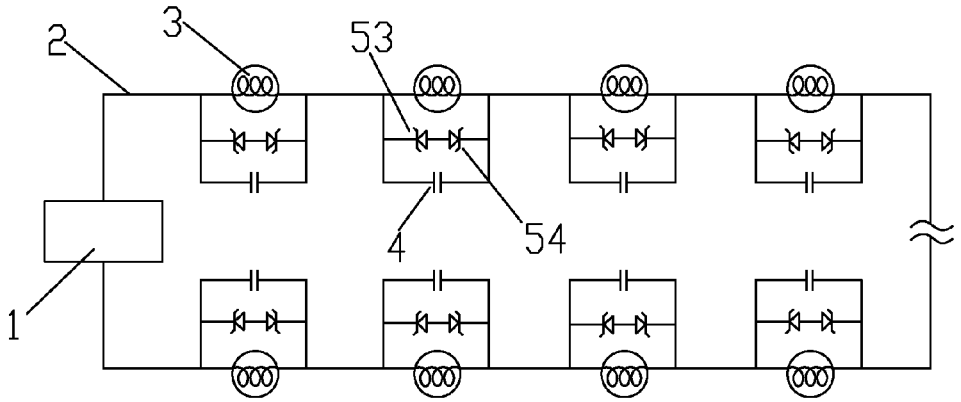
FIG. 8 is a part of the circuit diagram of a light string in accordance with an eighth embodiment of the invention.

Referring to FIG. 8, a light string according to a eighth embodiment of the present invention further includes a zener diode series branch connected in parallel to each light 3 when comparing with the first embodiment. The zener diode series branch includes two inverse connected zener diodes 53, 54. The zenner diodes 53, 54 are desired to perform voltage limiting and current limiting. The operating principle of the circuit is the same as that of the circuit of the first embodiment.

Figure 9:
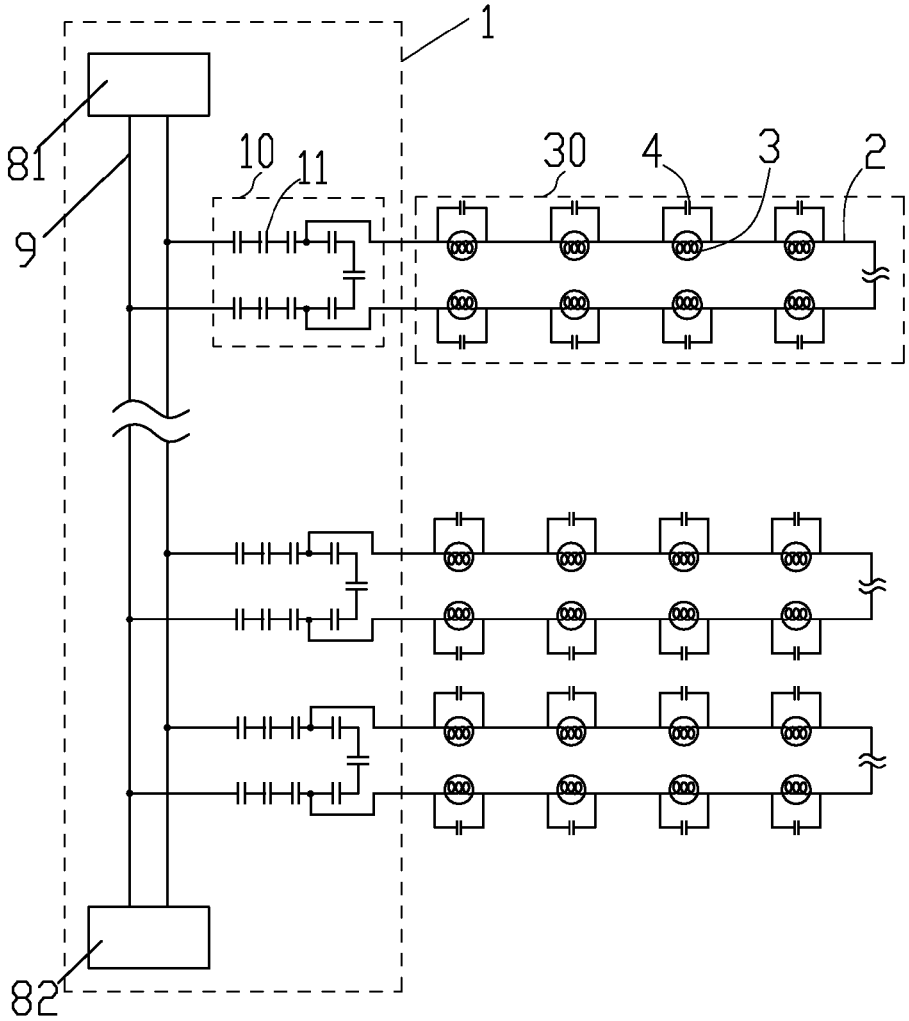
FIG. 9 is the circuit diagram of the light string in accordance with the first embodiment of the invention, the light string includes a power module.

Referring to FIG. 9, a complete circuit diagram of the light string according to the first embodiment of the present invention is illustrated. The light string includes a power module 1 and the plurality of lights 3. For clearly description, the series branch composed of the plurality of lights 3 is referred to a light series branch 30.

Figure 10:
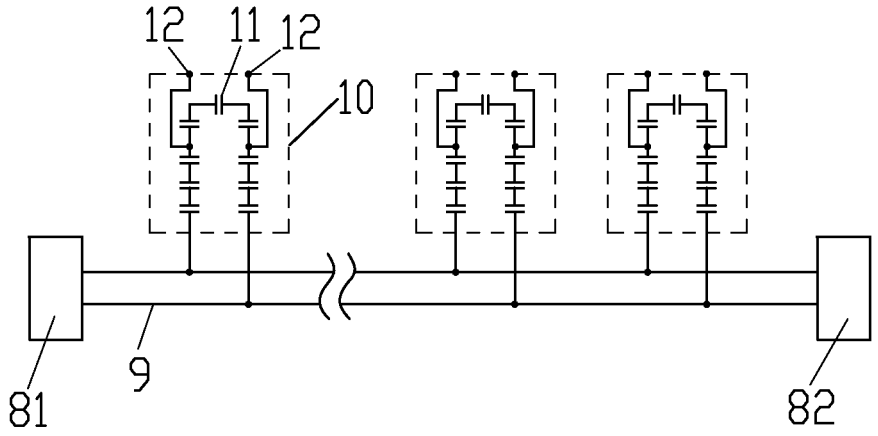
FIG. 10 is the circuit diagram of the power module of FIG. 9.

Please also refer to FIG. 10, the power module 1 mainly includes a power plug 81, a corresponding end socket 82, at least two electric wires (a fire wire, a null wire, and a grounding wire if there is three wires) 9 electrically connecting the power plug 81 and the end socket 82, and at least a capacitor series branch 10 electrically connected to the electric wires 9. In the embodiments, the power module 1 includes six capacitor series branches 10. The capacitor series branch 10 is used for receiving high voltage current from the AC power supply and supplying low voltage current to the light series branch 30.

Each capacitor series branch 10 includes a plurality of capacitors 11. The light series branch 30 is electrically connected in parallel to at least one of the capacitor 11 of the capacitor series branch 10. One capacitor series branch 10 corresponds to one light series branch 30. In the embodiment, the light series branch 30 is electrically connected in parallel to three capacitors 11. For the light series branch 30, the capacitor series branch 10 performs as a transformer, it transforms the high voltage AC from wire 9 to a safe low voltage AC to the light series branch 30. Comparing with the traditional transformer composed of cores and windings, capacitor series branch 10 is safer, its structure is more simple and easy to turn a design into production level. More important, it is very cheap to modify the circuit in order to get different output. You only need to increase or reduce the capacitors 11. Understandably, the power module 1 can be used in all the above embodiments. Preferably, the capacitors 11 of the capacitor series branch 10 are fixed on a circuit board to facilitate the connection with the light series branch 30 and make the capacitor series branch 10 more strong.

The wires 2 used in the light series branches 30 are larger than 22 AWG (American wire gauge), the electric wires 9 electrically connecting the power plug 81 and the end socket 82 and the wires used in the capacitor series branches 10 are smaller than 22 AWG.

And furthermore, for facilitating packing and transporting, and for facilitating user to assemble and collocate the light string, the light series branches 30 are detachably connected to the circuit board via detachably electric connectors, such as plugs and sockets. In this way, during manufacture, each power module 1 may include a plurality of capacitor series branches 10. The consumers can buy corresponding number of light series branches 30 or less, more meet the demands of the consumers. If the consumers need more light series branches 30, they can buy more power modules 1 to form a bigger light string by connecting the end socket 82 of a power module to the power plug 81 of another power module. Referring to FIG. 10, the output terminal of each capacitor series branches 10 is configured a sockets 12.

Figure 11:
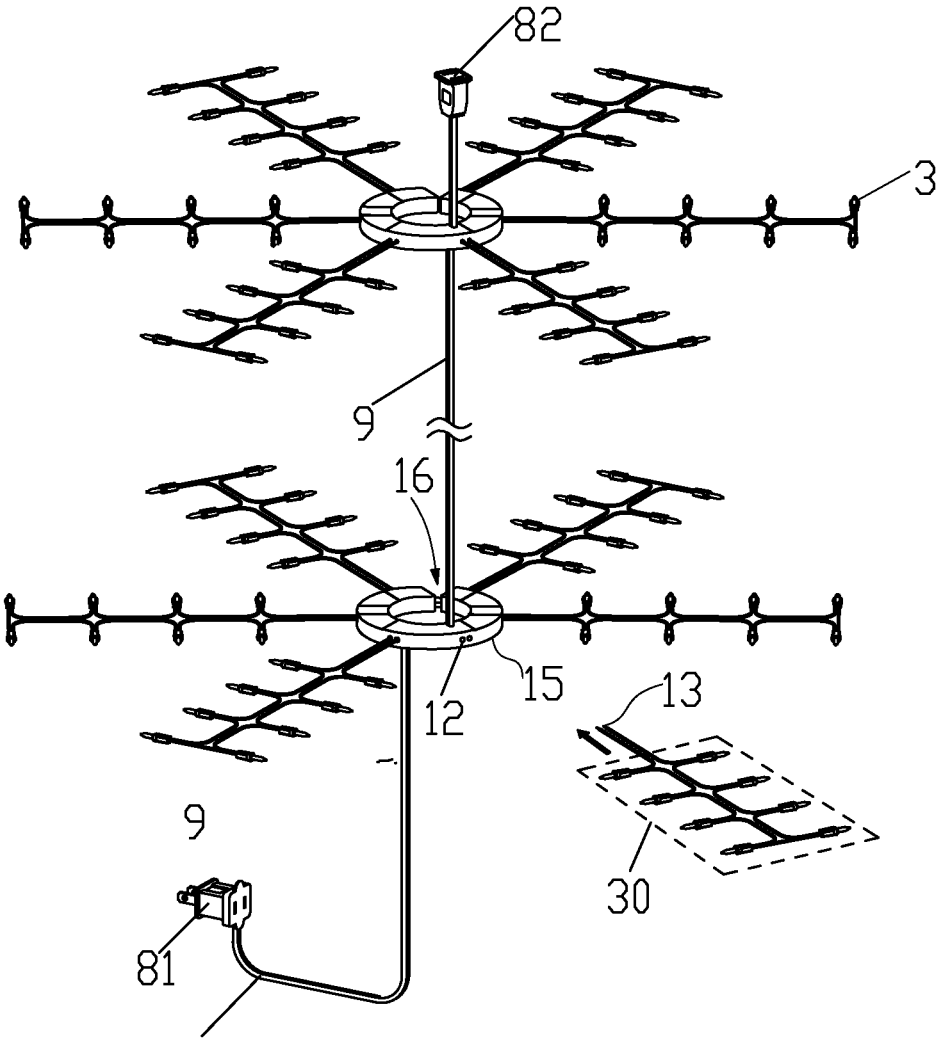
FIG. 11 is a perspective view of the light string in accordance with the first embodiment of the invention.
Figure 12:
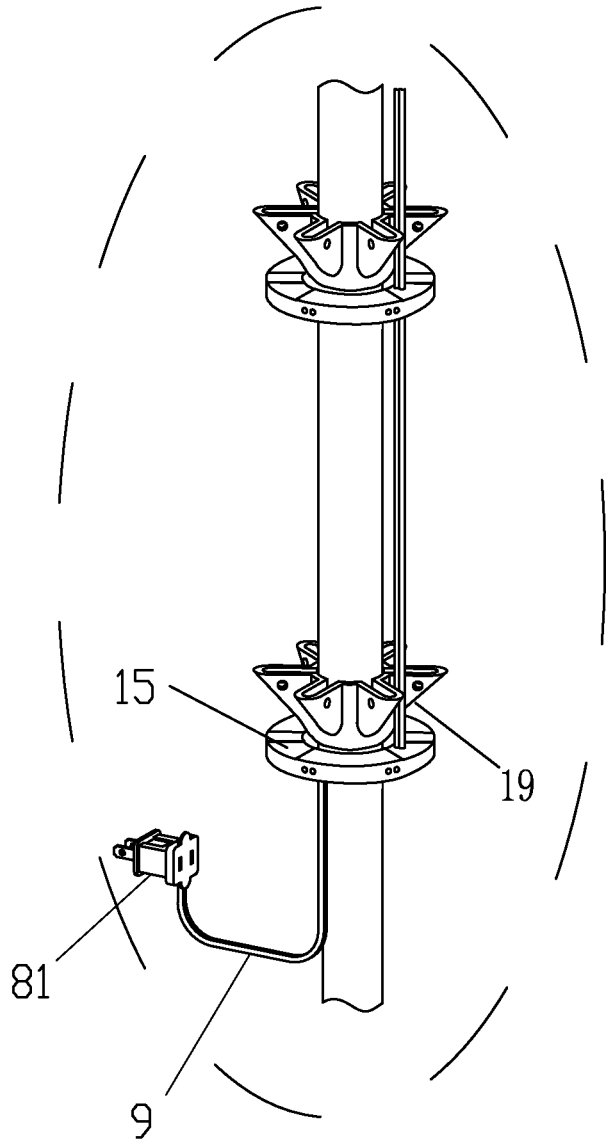
FIG. 12 is a perspective view showing a using condition of the light string with a post and a handle in accordance with the first embodiment of the invention.

Please also refer to FIG. 11, in an exemplary embodiment, the light string further includes at least one connecting base 15. Each connecting base 15 is used for receiving one circuit board which is fixed at least one capacitor series branch 10. Accordingly, each connecting base 15 is configured a plurality of connecting sockets 12 in its side wall and the connecting sockets 12 are electrically connected to corresponding capacitor series branches 10. Each connecting base 15 defines two wire holes on the upper and lower surfaces respectively. The wire 9 passes through the wire holes, and the power plug 81 and the end socket 82 are configured on the two sides of the connecting base respectively.

In the embodiment, the connecting base 15 is substantially annular. The connecting sockets 12 is configured in the side wall of the connecting base 15. The two wire holes are defined on the upper and lower surfaces respectively. The connecting base 15 defines a gap 16 to allow a post inserting a hole defined in the connecting base 15. The light series branch 30 can be shaped like a tree branch, the input of the light series branch 30 connects a plug 13 which matches the connecting socket 12. In use, the user can clamp several connecting bases 15 to the trunk of the Christmas tree (or to other post) via the gap 16, just under the handle 19. Then, connecting the light series branches 30 to the connecting bases 15 to take the shape of umbrella. It is very convenient to assemble.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A light string, comprising a plurality of lights, the lights being electrically connected in series and powered by an AC power supply;

wherein each light is connected in parallel to a capacitor, and the capacitors are non-polarized capacitors;

wherein the light string further comprises a capacitor series branch connected between the AC power supply and the plurality of lights, the capacitor series branch comprises a plurality of capacitors, two ends of the capacitor series branch are respectively used for connecting to the two outputs of the AC power supply; a light series branch composed of the plurality of lights is connected in parallel to at least one of the capacitors of the capacitor series branch; and wherein the light string further comprises a power plug, a corresponding end socket, and at least two electric wires electrically connecting the power plug and the end socket; a plurality of capacitor series branches are electrically connected in parallel to the electric wires, the capacitors of the plurality of capacitor series branch are configured on at least one circuit board.

2. The light string of claim 1, wherein a lamp of each light is one of a tungsten filament lamp and an LED lamp.

3. The light string of claim 1, wherein the light series branch is detachably connected to the circuit board to electrically connected to one of the capacitor series branches.

4. The light string of claim 3, wherein the light string further comprises at least a connecting base each for receiving the at least one circuit board, each connecting base comprises a plurality of connecting sockets which is configured on the side wall of the connecting base and is electrically connected to the corresponding capacitor series branches.

5. The light string of claim 4, wherein each connecting base defines two wire holes on the upper and lower surfaces respectively, the power plug and the end socket is configured on the two sides of the connecting base respectively.

6. The light string of claim 5, wherein the connecting base is substantially annular and defines a gap therein to allow a post inserting a hole defined in the connecting base.

7. The light string of claim 5, wherein the wires used in the light series branches are larger than 22 AWG, the electric wires electrically connecting the power plug and the end socket and the wires used in the capacitor series branches are smaller than 22 AWG.

* * * * *